US009427627B2

(12) United States Patent
Chou

(10) Patent No.: US 9,427,627 B2
(45) Date of Patent: Aug. 30, 2016

(54) HEAD STRAP AND BUCKLE DEVICE FOR SWIMMING/DIVING GOGGLES

(71) Applicant: Terry Chou, Tainan (TW)

(72) Inventor: Terry Chou, Tainan (TW)

( * ) Notice: Subject to any disclaimer, the term of this patent is extended or adjusted under 35 U.S.C. 154(b) by 35 days.

(21) Appl. No.: 14/517,739

(22) Filed: Oct. 17, 2014

(65) Prior Publication Data

US 2016/0107035 A1 Apr. 21, 2016

(51) Int. Cl.
*A61F 9/02* (2006.01)
*A63B 33/00* (2006.01)

(52) U.S. Cl.
CPC ..... *A63B 33/002* (2013.01); *A63B 2033/004* (2013.01)

(58) Field of Classification Search
CPC ..... A63B 33/00; A63B 33/002; A63B 2033/004; A63B 2033/006; A63B 2033/008; Y10T 24/4014; Y10T 24/406; Y10T 24/4065; A61F 9/025; A61F 9/027; A61F 9/029
USPC ..... 2/425, 427, 428, 448, 450, 426, 452, 2/440, 442, 445, 446, 245
See application file for complete search history.

(56) References Cited

U.S. PATENT DOCUMENTS 6,691,378 B1 * 2/2004 Chou ..... A63B 33/002 2/428
6,832,394 B1 * 12/2004 Chiang ..... A63B 33/002 2/428
7,146,653 B2 * 12/2006 Chou ..... A63B 33/002 2/426
7,181,780 B1 * 2/2007 Chiang ..... A63B 33/002 2/426
7,444,689 B2 * 11/2008 Chiang ..... A63B 33/002 2/428
7,631,400 B2 * 12/2009 Chiang ..... A63B 33/002 2/426
7,810,175 B2 * 10/2010 Chiang ..... A63B 33/002 2/448
7,856,674 B2 * 12/2010 Chou ..... A63B 33/002 2/452
7,966,701 B2 * 6/2011 Shiue ..... A61F 9/027 2/452
8,117,680 B1 * 2/2012 Chou ..... A63B 33/002 2/450
8,312,603 B2 * 11/2012 Chou ..... A63B 33/002 2/426
8,429,797 B2 * 4/2013 Shiue ..... A44B 11/20 2/452
8,707,522 B2 * 4/2014 Shiue ..... A63B 33/002 24/170
8,959,670 B2 * 2/2015 Chiang ..... A63B 33/002 2/440
9,009,872 B2 * 4/2015 Chiang ..... A63B 33/002 2/426
9,241,542 B2 * 1/2016 Kuo ..... A44B 11/006
2014/0359923 A1 * 12/2014 Chiang ..... A63B 33/002 2/442

* cited by examiner

*Primary Examiner* — Anna Kinsaul
*Assistant Examiner* — Griffin Hall

(57) ABSTRACT

Swimming/diving goggles includes a main body with a head strap coupling portion. An attachment portion is formed on an end of a head strap. A buckle includes two sidewalls defining a space. An eccentric axle extends between upper front portions of the sidewalls and engages with the attachment portion. Front and rear posts extend between the sidewalls and define a passage. The end of the head strap extends through a rear opening of the buckle into the space, extends through the passage, and is wound around to form a bend. The head strap includes an inner section and an outer section having the attachment portion. The head strap and the buckle are jointly movable. A tightening force acting on the inner section makes the inner section form another bend in the passage. The inner section presses against the front post and the rear post to position the head strap.

9 Claims, 12 Drawing Sheets

HEAD STRAP AND BUCKLE DEVICE FOR SWIMMING/DIVING GOGGLES

BACKGROUND OF THE INVENTION

The present invention relates to a head strap and buckle device for swimming/diving goggles and, more particularly, to a head strap and buckle device for swimming/diving goggles allowing easy adjustment of a tightening length of the head strap by a user and providing enhanced tightening by fixing an end of the head strap relative to the buckle.

A type of conventional swimming goggles includes two lenses, two frames, a bridge, a buckle, and a head strap. The buckle is used to assemble with the head strap and to allow adjustment of the tightening length of the head strap. FIG. 10 shows a conventional head strap and buckle device for swimming/diving goggles. An end of the buckle 1' includes a coupling portion 11' for coupling with the swimming goggles. The other end of the buckle 1' includes a tightening portion 12' for coupling with a soft head strap 2'. The tightening portion 12' includes two posts 121' and 122' in a center thereof and a notch 123' in an end thereof.

The coupling portion 11' is coupled with a body 3' of the swimming goggles. The head strap 2' extends between the notch 123' and the post 121' and is wound around the posts 121' and 122'. An end 124' of the head strap 2' again extends between the notch 123' and the post 121' to fix the tightening length of the head strap 2'.

However, when the user is intended to adjust the tightening length of the head strap 2', the user has to remove the body 3' from the head of the user, loosen the head strap 2' at the posts 121' and 122' and the notch 123', and then adjust the length of the head strap 2', which is time-consuming. However, after adjustment, the large spacing a between the end 124' of the head strap 2' and the buckle 1' results in difficult positioning of the end 124' of the head strap 2', leading to shifting of the end 124' (see phantom lines) and unsatisfactory tightening.

FIG. 11 show another conventional head strap and buckle device for swimming/diving goggles. The buckle 40' includes a pressing portion 4', a clamping portion 5', and a connecting portion 6'. The connecting portion 6' is around a mounting peg 81' of a main body 8' of the swimming/diving goggles. The pressing portion 4' includes a post 41' around which the head strap 7' extends. The clamping portion 5' includes a clamping hole 51' in which the head strap 7' can fold in half and a retaining edge 52' for retaining the head strap 7'. An end 71' of the head strap 7' can be pulled to tighten the head strap 7' around the head of the user. When the head strap 7' is released, the head strap 7' exerts a pulling force to make the post 41' and the retaining edge 52' tightly position the head strap 7'. When loosening of the head strap 7' is desired, the user can press the pressing portion 4' to increase the spacing between the post 41' and the retaining edge 52' (see the double arrow in FIG. 11). An example of such a head strap and buckle device for swimming/diving goggles is shown in U.S. Pat. No. 6,691,378. However, the spacing b between the end 71' of the head strap 7' and the buckle 40' during tightening is too large and results in difficult positioning of the end 71' of the head strap 7', leading to shifting of the end 71' (see phantom lines) and unsatisfactory tightening.

FIG. 12 shows another conventional head strap and buckle device for swimming/diving goggles. The buckle 91' is provided on a side of a main body 90' of the swimming/diving goggles for coupling with the head strap 92'. The buckle 91' includes a base 911', a cover 912', and a button 913'. The button 913' includes a shaft 914' rotatably connected to the base 911'. The button 913' further includes an engagement end 915' and an abutment end 916'. The abutment end 916' can press against an elastic portion 901' of the main body 90'. When the button 913' is not pressed, the engagement end 915' engages with teeth 902' of the head strap 92', which only permits pulling of an end 921' of the head strap 92 in the tightening direction. When the button 913' is pressed, the engagement end 915' disengages from the teeth 920' of the head strap 92' to release the head strap 92'. An example of such a head strap and buckle device for swimming/diving goggles is shown in U.S. Pat. No. 7,020,904. However, the spacing C between the end 921' of the head strap 92' and the buckle 91' during pulling of the head strap 92' is too large and results in difficult positioning of the end 921' of the head strap 92', leading to shifting of the end 921' (see phantom lines) and unsatisfactory tightening. Furthermore, the head strap and buckle device includes many components and, thus, results in troublesome assembly. Furthermore, the engagement end 915' cannot reliably engage with the teeth 920' of the head strap 92' when the elasticity of the elastic portion 901' is insufficient.

BRIEF SUMMARY OF THE INVENTION

An objective of the present invention is to provide a head strap and buckle device for swimming/diving goggles allowing the user to adjust the tightness of the head strap while providing enhanced assembling stability. Furthermore, an end of the head strap can be fixed relative to the buckle to provide enhanced tightening.

Swimming/diving goggles in accordance with the present invention includes a main body having two sides. Each of the two sides of the main body includes a head strap coupling portion. A head strap includes first and second ends. An attachment portion is formed on at least one of the first and second ends of the head strap. The head strap is coupled with the main body and is wound around a head strap turnaround component. At least one buckle includes first and second sidewalls. Each of the first and second sidewalls includes an upper edge, a lower edge spaced from the upper edge in a height direction, a front edge, and a rear edge spaced from the front edge in a length direction perpendicular to the height direction. A space is defined between the first and second sidewalls. An eccentric axle extends between upper front portions of the first and second sidewalls. A front post and a rear post extend between the first and second sidewalls and are parallel to each other. The front post is located between the eccentric axle and the rear post in the length direction. The rear post is located between the front post and the rear edge in the length direction. The eccentric axle is located between the upper edges and the front post in the height direction. The rear post is spaced from the upper edges of the first and second sidewalls in the height direction. A rear opening is formed between the rear post and the upper edges of the first and second sidewalls. A passage is defined between the front and rear posts and extends in the height direction.

The first end of the head strap extends through the rear opening into the space of the at least one buckle, extends through the passage of the at least one buckle, and is wound around the head strap turnaround component to form a bend. The attachment portion of the head strap engages with the eccentric axle. The head strap includes an outer section and an inner section on two sides of the bend. The outer section includes the attachment portion. The head strap and the at least one buckle are jointly movable.

A tightening force acting on the inner section of the head strap makes the inner section form a bend in the passage. The inner section of the head strap presses against the front post and the rear post, retaining the head strap in place.

The attachment portion of the head strap can include an axle hole, and the eccentric axle is received in the axle hole.

In examples, the attachment portion of the head strap is located adjacent to an end edge of the first end of the head strap, and a holding portion is formed between the first end and the attachment portion of the head strap.

In an example, the attachment portion is located on the first end of the head strap.

The front post can include a lower engagement edge on a lower rear portion thereof, and the rear post can include an upper engagement edge on an upper front portion thereof.

The upper front portion of each of the first and second sidewalls of the at least one buckle can include an eccentric hole, and the eccentric axle is received in the eccentric holes.

In an example, each head strap coupling portion of the main body includes a pin forming the head strap turnaround component. The at least one buckle includes two buckles. The attachment portion is formed on each of the first and second ends of the head strap. Each of the first and second ends of the head strap extends through the rear opening of one of the two buckles into the space of one of the two buckles, extends through the passage of one of the two buckles, and is wound around one of the pins of the main body to form the bend. Each attachment portion of the head strap engages with the eccentric axle of one of the two buckles.

In another example, the at least one buckle includes a buckle. The attachment portion is formed on the first end of the head strap. The head strap turnaround component is a connecting member including a first side and a second side having a peg. The head strap is coupled with the head strap coupling portions. The first and second ends of the head strap are located behind the main body. The second end of the head strap is fixed to the first side of the connecting member. The first end of the head strap extends through the rear opening into the space of the buckle, extends through the passage of the buckle, and is wound around the peg. The attachment portion of the head strap engages with the eccentric axle of the buckle.

In a further example, the at least one buckle includes first and second buckles. The attachment portion is formed on each of the first and second ends of the head strap. The head strap turnaround component is a connecting member including first and second pegs. The head strap is coupled with the head strap coupling portions. The first and second ends of the head strap are located behind the main body. The first end of the head strap extends through the rear opening into the space of the first buckle, extends through the passage of the first buckle, and is wound around the first peg. The attachment portion on the first end of the head strap engages with the eccentric axle of the first buckle. The second end of the head strap extends through the rear opening into the space of the second buckle, extends through the passage of the second buckle, and is wound around the second peg. The attachment portion on the second end of the head strap engages with the eccentric axle of the second buckle.

The present invention will become clearer in light of the following detailed description of illustrative embodiments of this invention described in connection with the drawings.

DESCRIPTION OF THE DRAWINGS

FIG. 8A is an enlarged view of a circled portion of FIG. 8.

DETAILED DESCRIPTION OF THE INVENTION

Figure 1:
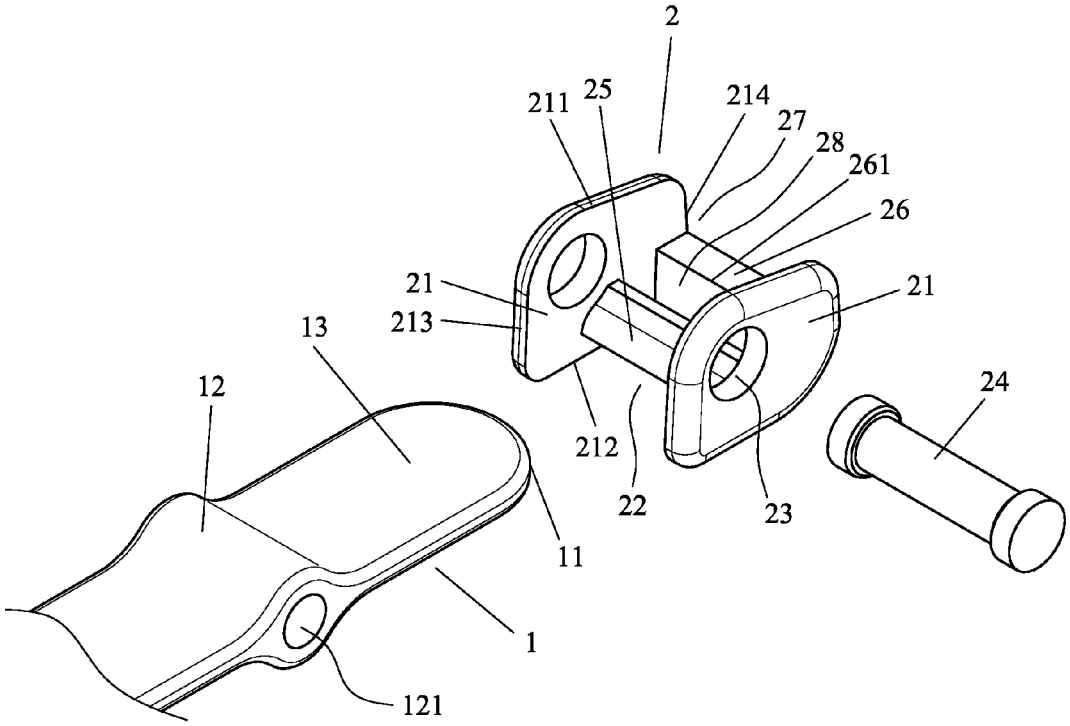
FIG. 1 is a perspective view of a head strap and buckle device for swimming/diving goggles of a first example according to the present invention.
Figure 2:
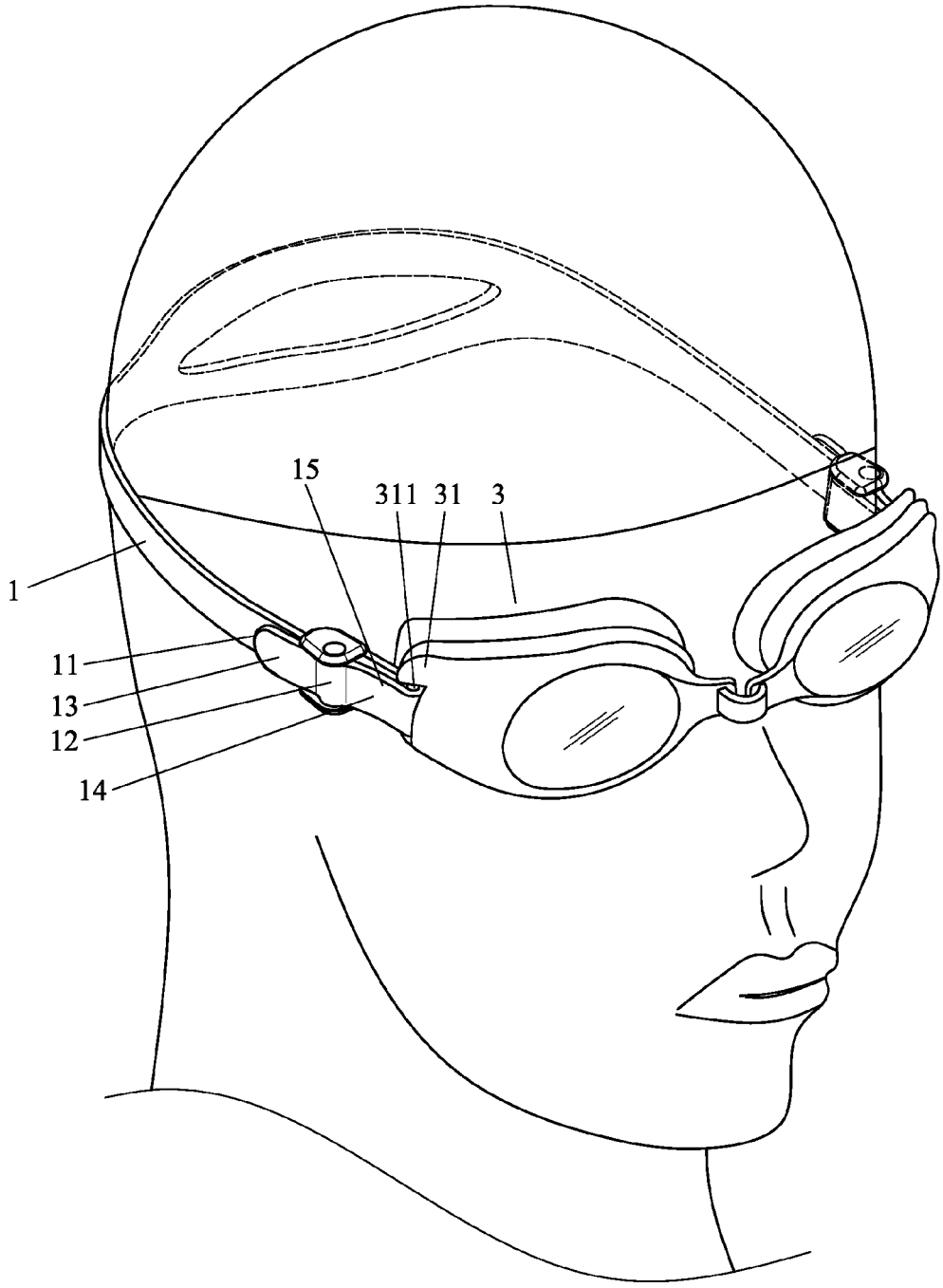
FIG. 2 is a perspective view of swimming/diving goggles of the first example, with the head strap and buckle device according to the present invention mounted to each of two sides of the swimming/diving goggles.
Figure 3:
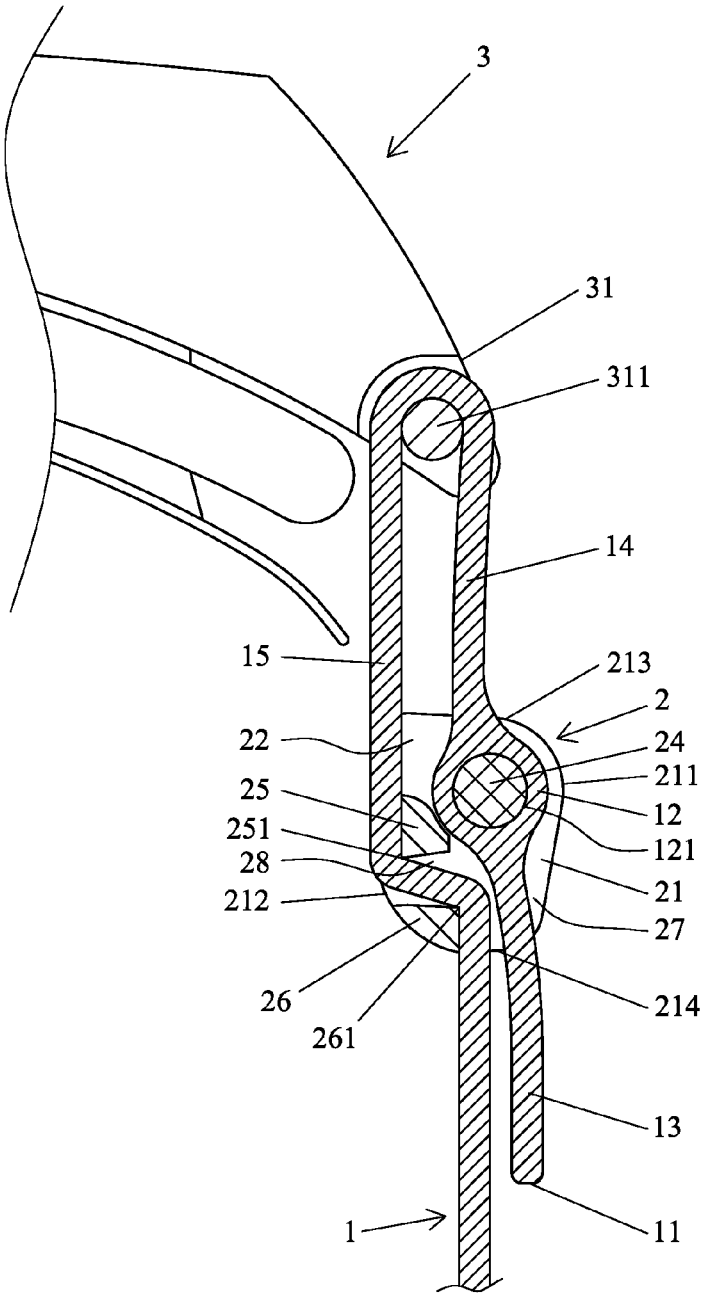
FIG. 3 is a partial, cross sectional view of the swimming/diving goggles of FIG. 2, with the head strap not tightened.

With reference to FIGS. 1-3, swimming/diving goggles of a first example according to the present invention includes a main body 3, a head strap turnaround component, a head strap 1, and a buckle 2 on each of two sides of the main body 3. Each side of the main body 3 includes a head strap coupling portion 31. In this example, each head strap coupling portion 31 of the main body 3 includes a pin 311 forming the head strap turnaround component. The head strap 1 is made of a flexible material and includes first and second ends 11. An attachment portion 12 is formed on each of the first and second ends 11 of the head strap 1, is located adjacent to an end edge of one of the first and second edges 11, and includes an axle hole 121. A holding portion 13 of an appropriate length is formed between each attachment portion 12 and the end edge of a corresponding one of the first and second ends 11 of the head strap 1.

Each buckle 2 includes first and second sidewalls 21 parallel to each other. Each of the first and second sidewalls 21 includes an upper edge 211, a lower edge 212 spaced from the upper edge 211 in a height direction, a front edge 213, and a rear edge 214 spaced from the front edge 213 in a length direction perpendicular to the height direction. A space 22 is defined between the first and second sidewalls 21. An eccentric axle 24 extends between upper front portions of the first and second sidewalls 21. In this example, the upper front portion of each of the first and second sidewalls 21 includes an eccentric hole 23. The eccentric axle 24 is received in the eccentric holes 23 and extends through the axle hole 121 of one of the attachment portions 12 of the head strap 1.

A front post 25 and a rear post 26 extend between the first and second sidewalls 21 and are parallel to each other. The front post 25 is located between the eccentric axle 24 and the rear post 26 in the length direction. The rear post 26 is located between the front post 25 and the rear edge 214 in the length direction. The eccentric axle 24 is located between the upper edges 211 and the front post 25 in the height direction. The rear post 26 is spaced from the upper edges 211 of the first and second sidewalls 21 in the height direction. A rear opening 27 is formed between the rear post 26 and the upper edges 211 of the first and second sidewalls 21. A passage 28 is defined between the front and rear posts 25 and 26 and extends in the height direction. A spacing between the front post 25 and the lower edge 212 of each of the first and second sidewalls 21 is substantially the same as the width of the head strap 1. The front post 25 includes a lower engagement edge 251 on a lower rear portion thereof. The rear post 26 includes an upper engagement edge 261 on an upper front portion thereof.

Each of the first and second ends 11 of the head strap 1 extends through the rear opening 27 of one of the two buckles 2 into the space 22 of one of the two buckles 2, extends through the passage 28 of one of the two buckles 2, and is wound around one of the pins 311 of the main body 3 to form a bend. Each attachment portion 12 of the head strap 1 engages with the eccentric axle 24 of one of the two buckles 2. Each holding portion 13 extends rearwards through the rear opening 27 of one of the buckles 2. After assembly, on each side of the main body 3, the head strap 1 includes an outer section 14 and an inner section 15 on two sides of the bend, with the outer section 14 including the attachment portion 12 and with the outer section 14 of the head strap 1 and each buckle 2 being jointly movable. A tightening force acting on the inner section 15 of the head strap 1 moves the passage 28 to be in a direction perpendicular to the inner section 15 of the head strap 1 and forms a bend in the passage 28. Furthermore, the inner section 15 of the head strap 1 presses against the lower engagement edge 251 of the front post 25 and the upper engagement edge 261 of the rear post 26, retaining the head strap 1 in place.

Figure 4:
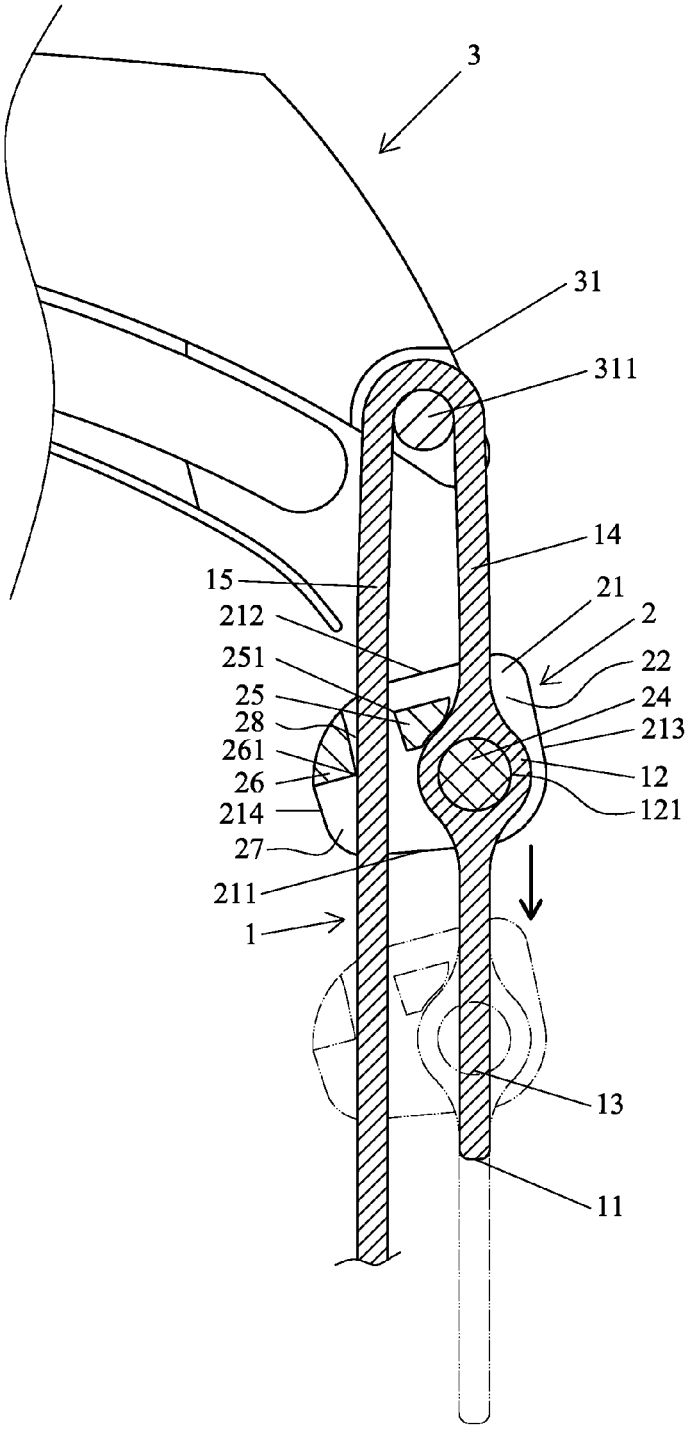
FIG. 4 is a view similar to FIG. 3, with the head strap pulled to pivot a buckle.

FIG. 4 shows a side of the swimming/diving goggle, with the other side being a mirror image. When it is desired to proceed with a large extent of tightening length adjustment, the user can pull the head strap 1 rearwards by the holding portion 13 of the head strap 1 or the eccentric axle 24. The buckle 2 pivots such that the passage 28 is moved to be in a front/rear direction of the main body 3. Thus, the inner section 15 of the head strap 1 is not retained by the front and rear posts 25 and 26, allowing adjustment of the tightening length of the head strap 1.

Figure 5:
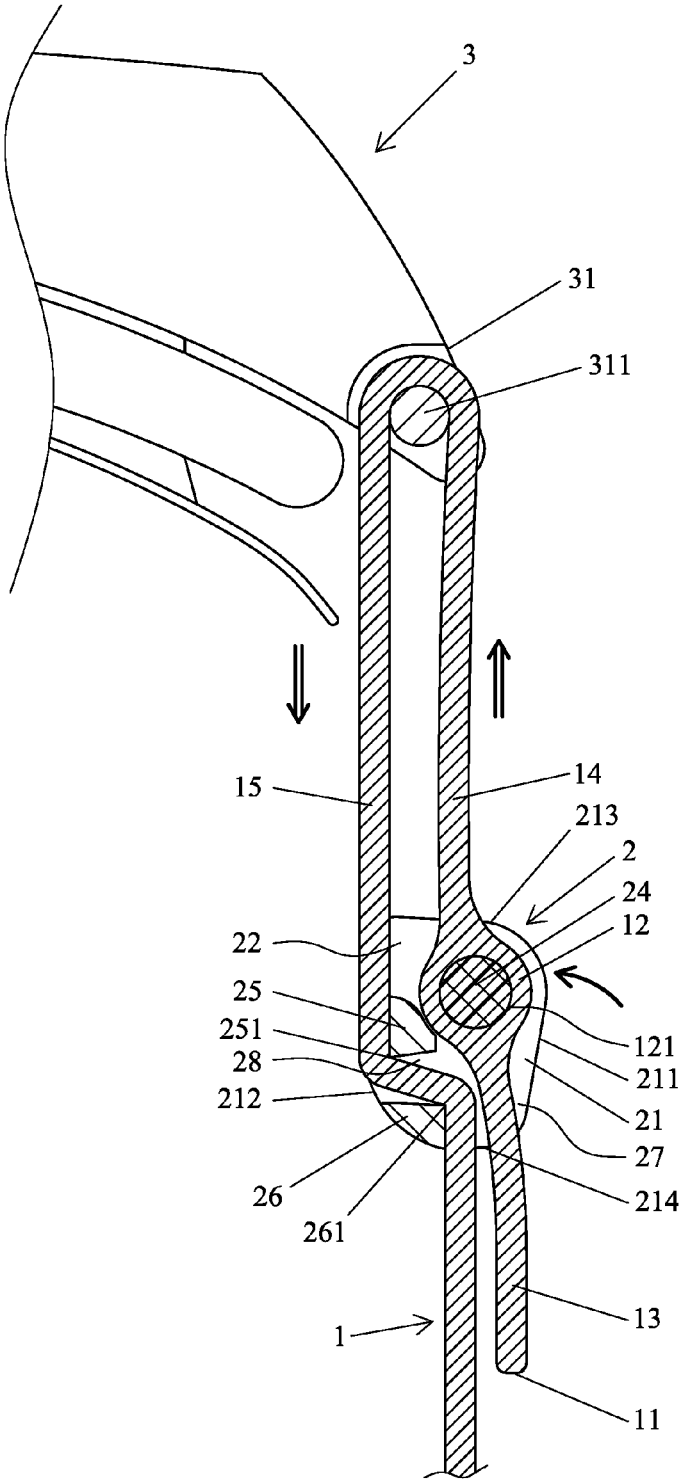
FIG. 5 is a view similar to FIG. 4, with the head strap tightened.
Figure 6:
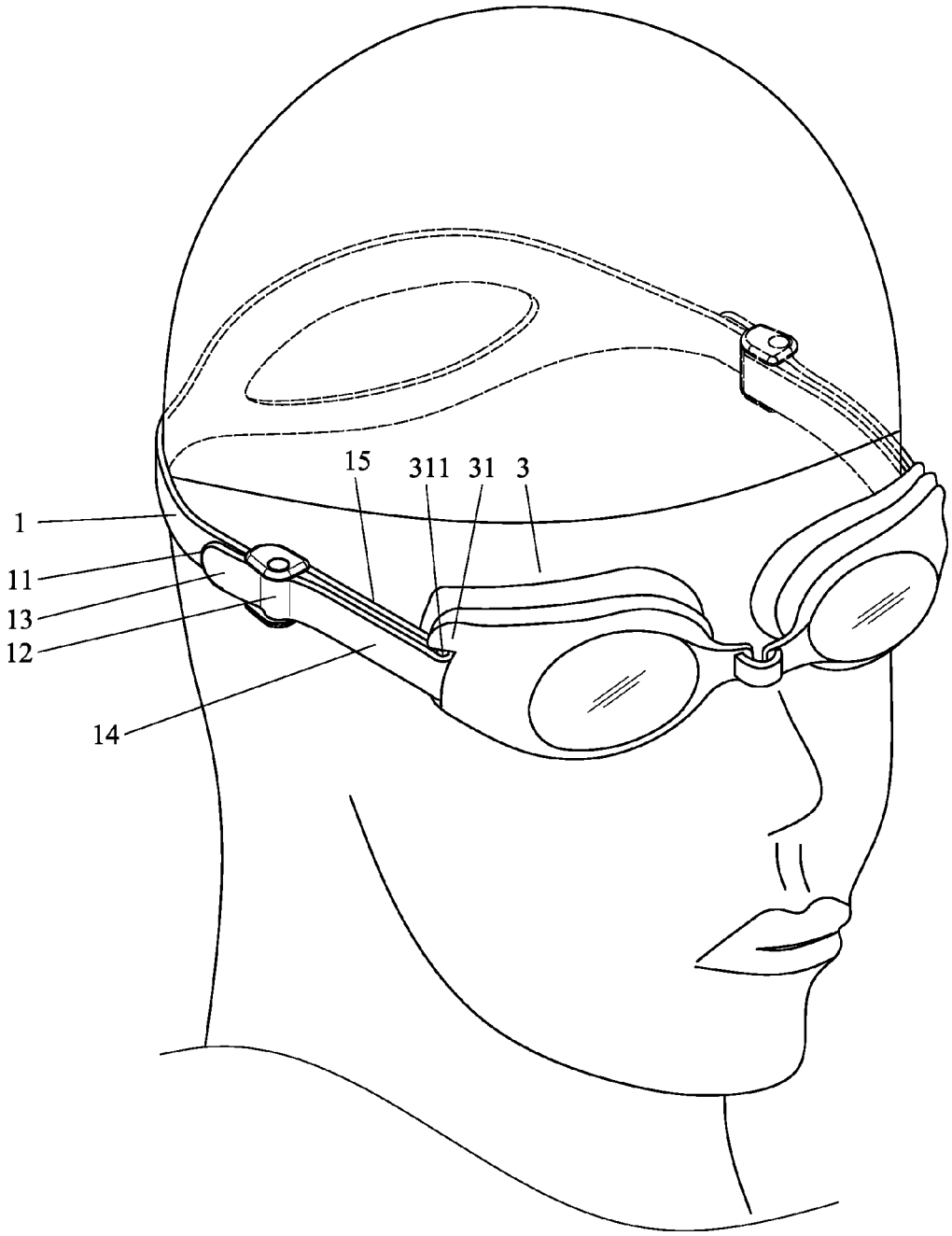
FIG. 6 is a view similar to FIG. 2, with the head strap tightened.

Please referrer to FIGS. 5 and 6. FIG. 5 shows a side of the swimming/diving goggle, with the other side being a mirror image. After tightening, the holding portion 13 of the head strap 1 or the eccentric axle 24 is released, the tightening force (see the double arrow) acting on the inner section 15 of the head strap 1 returns the buckle 2 to a position in which the passage 28 is perpendicular to the inner section 15, forming a bend such that the lower engagement edge 251 of the front post 25 and the upper engagement edge 261 of the rear post 26 retain the adjusted head strap 1 in place. The operation is easy. Furthermore, the outer section 14 of the head strap 1 becomes longer after adjustment, but the spacing between the first end 11 and the buckle 2 remains unchanged, preventing dangling of the excessively long length between the first end 11 and the buckle 2 while providing enhanced tightening effect.

Figure 7:
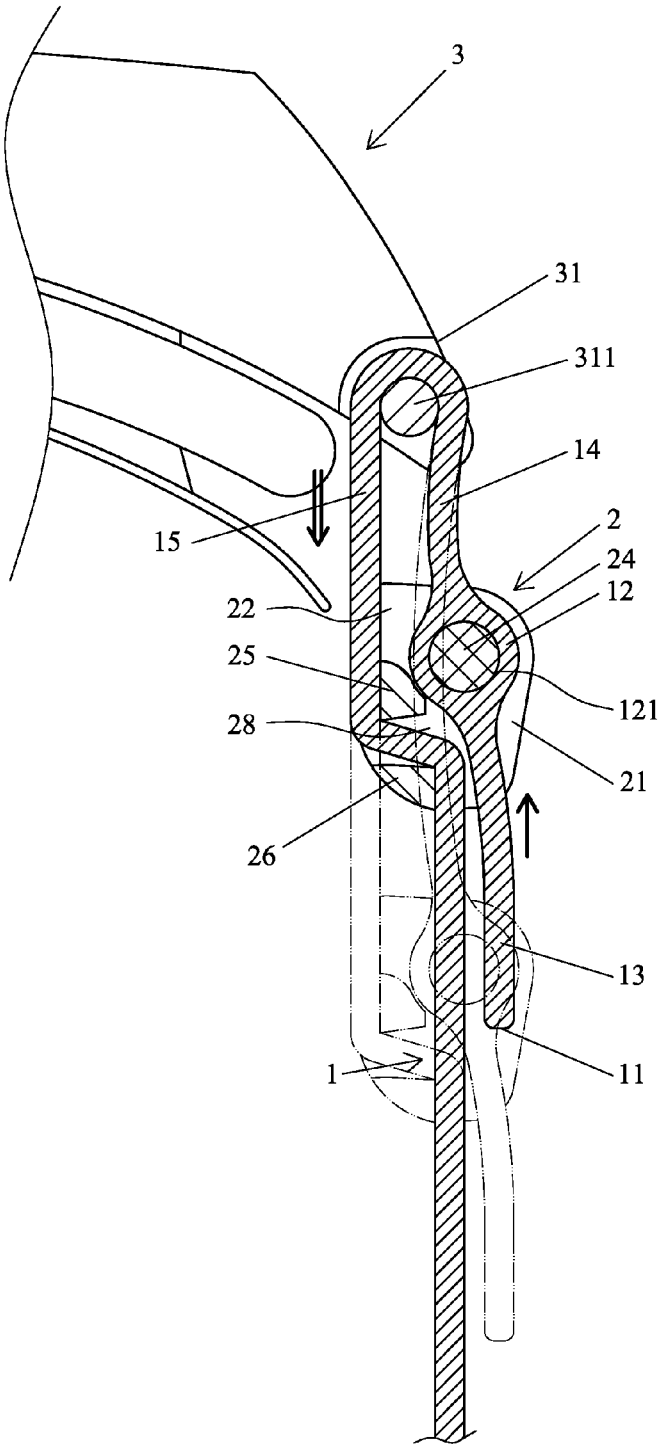
FIG. 7 is a view similar to FIG. 5, illustrating loosening of the head strap.

FIG. 7 shows a side of the swimming/diving goggle, with the other side being a mirror image. When it is desired to release the head strap 1, the user can apply a small force in a direction indicated by the upwards arrow in FIG. 7 to move the buckle 2 forwards. As further shown in FIG. 7, head strap 1 and buckle 2 are jointly movable as a whole in a same direction with a same distance. The force applied by the user is larger than the engagement force between the head strap 1 and the buckle 2. In cooperation with the tightening force acting on the head strap 1 indicated by the double arrow, the length of the outer section 14 of the head strap 1 can easily be reduced, which is easy in operation.

Figure 8:
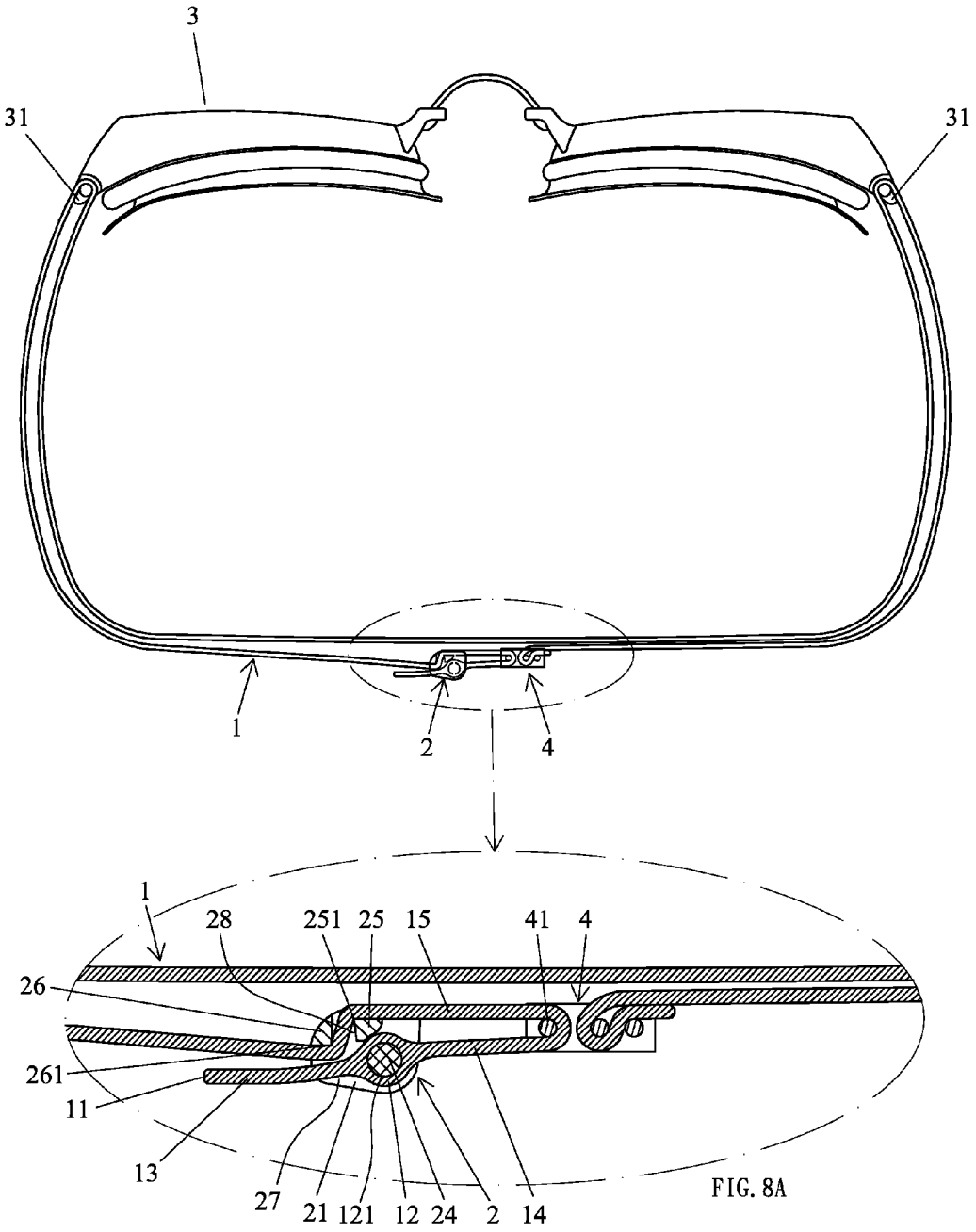
FIG. 8 is a top view of swimming/diving goggles of a second example according to the present invention, with the head strap and buckle device according to the present invention mounted behind a main body of the swimming/diving goggles.

FIGS. 8 and 8A show swimming/diving goggles of a second example according to the present invention. In this example, the swimming/diving goggles includes only one buckle 2 mounted behind the main body 3, and the attachment portion 12 is formed on the first end 11 of the head strap 1. Furthermore, the head strap turnaround component is a connecting member 4 including a first side and a second side having a peg 41. The head strap 1 is coupled with the head strap coupling portions 31, and the first and second ends 11 of the head strap 1 are located behind the main body 3. The second end 11 of the head strap 1 is fixed to the first side of the connecting member 4. The first end 11 of the head strap 1 extends through the rear opening 27 into the space 22 of the buckle 2, extends through the passage 28 of the buckle 2, and is wound around the peg 41. The attachment portion 12 of the head strap 1 engages with the eccentric axle 24 of the buckle 2.

The holding portion 13 on the first end 11 of the head strap 1 extends rearwards through the rear opening 27 of the buckle 2. After assembly, the head strap 1 includes an outer section 14 and an inner section 15 on two sides of the peg 41, with the outer section 14 including the attachment portion 12 and with the outer section 14 of the head strap 1 and the buckle 2 being jointly movable. A tightening force acting on the inner section 15 of the head strap 1 moves the passage 28 to be in a direction perpendicular to the inner section 15 of the head strap 1 and forms a bend in the passage 28. Furthermore, the inner section 15 of the head strap 1 presses against the lower engagement edge 251 of the front post 25 and the upper engagement edge 261 of the rear post 26, retaining the head strap 1 in place. Operation of the second example is substantially the same as the first example for tightening and loosening the head strap 1.

Figure 9:
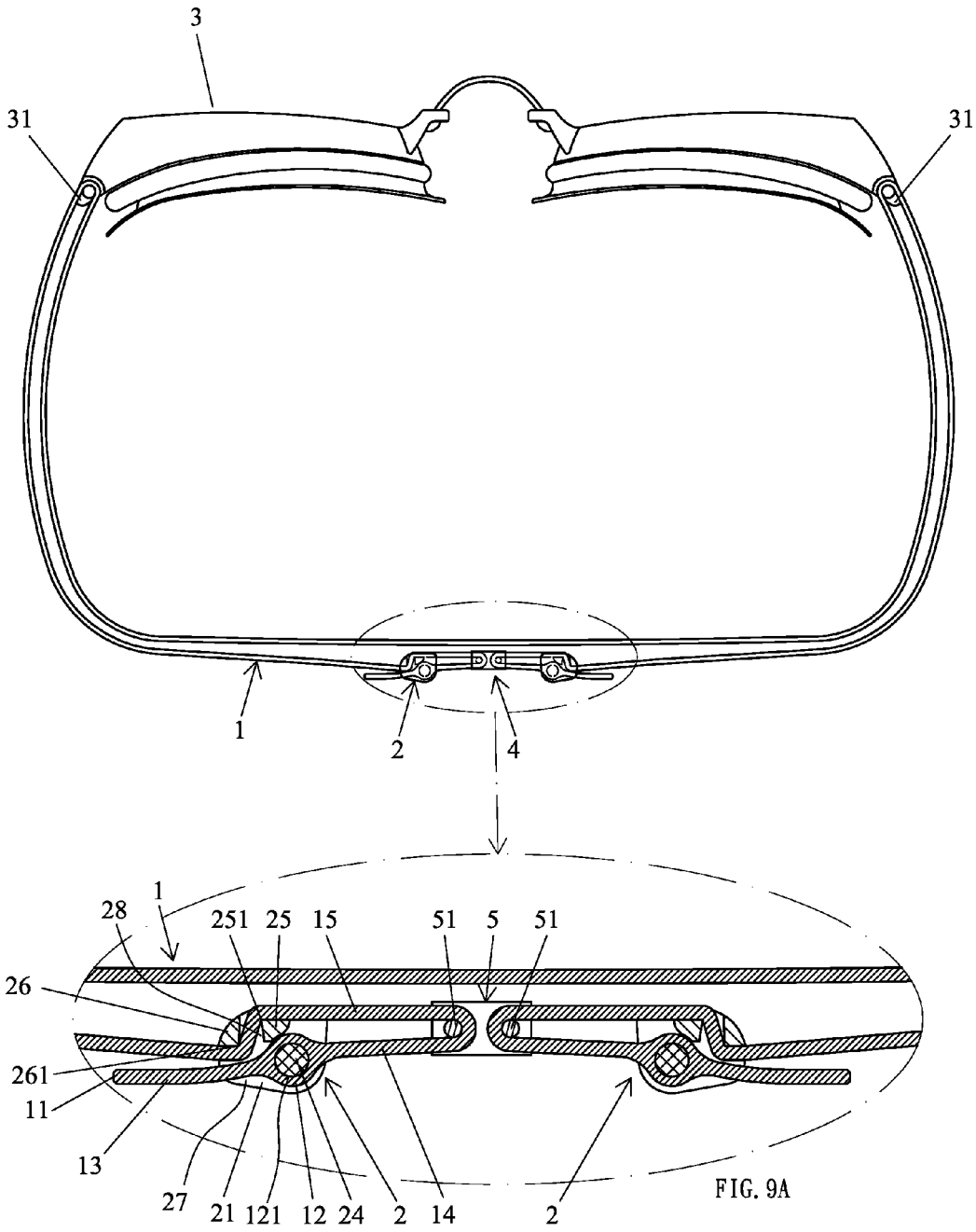
FIG. 9 is a top view of swimming/diving goggles of a third example according to the present invention, with two head strap and buckle devices according to the present invention mounted behind the main body of the swimming/diving goggles.
Figure 10:
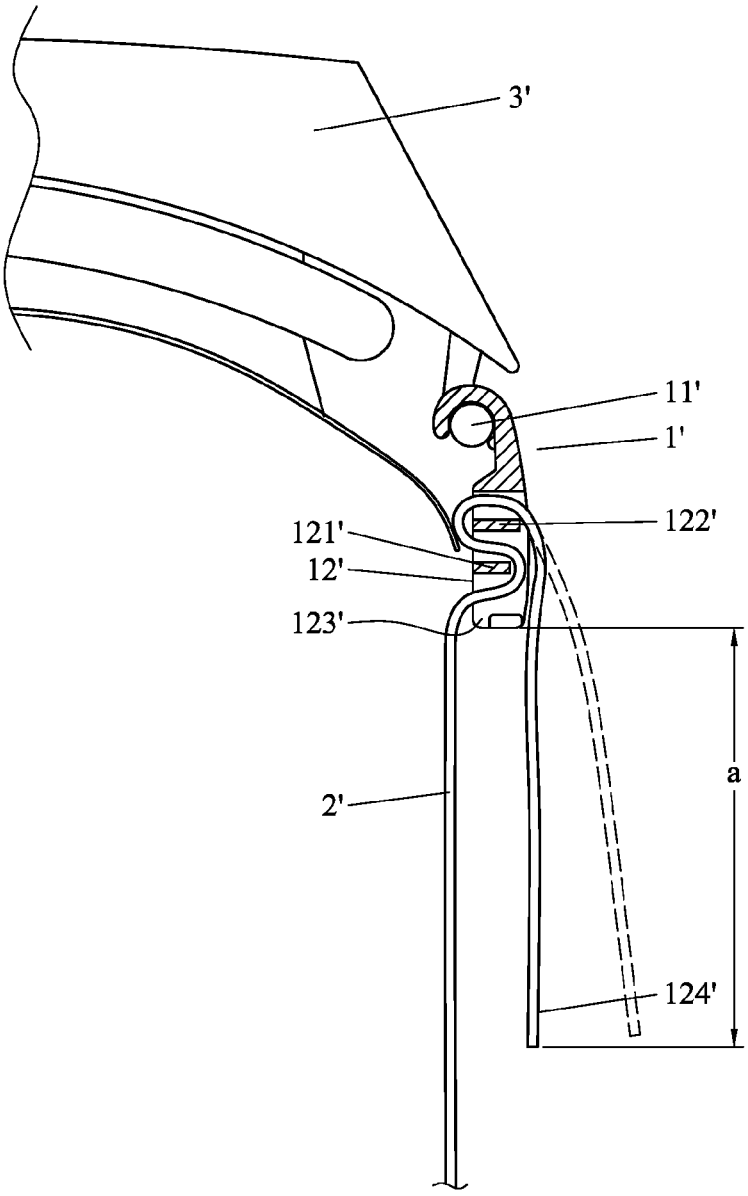
PRIOR ART F I G . 10
FIG. 10 is a partial, top view illustrating a conventional head strap and buckle device for swimming/diving goggles.
Figure 11:
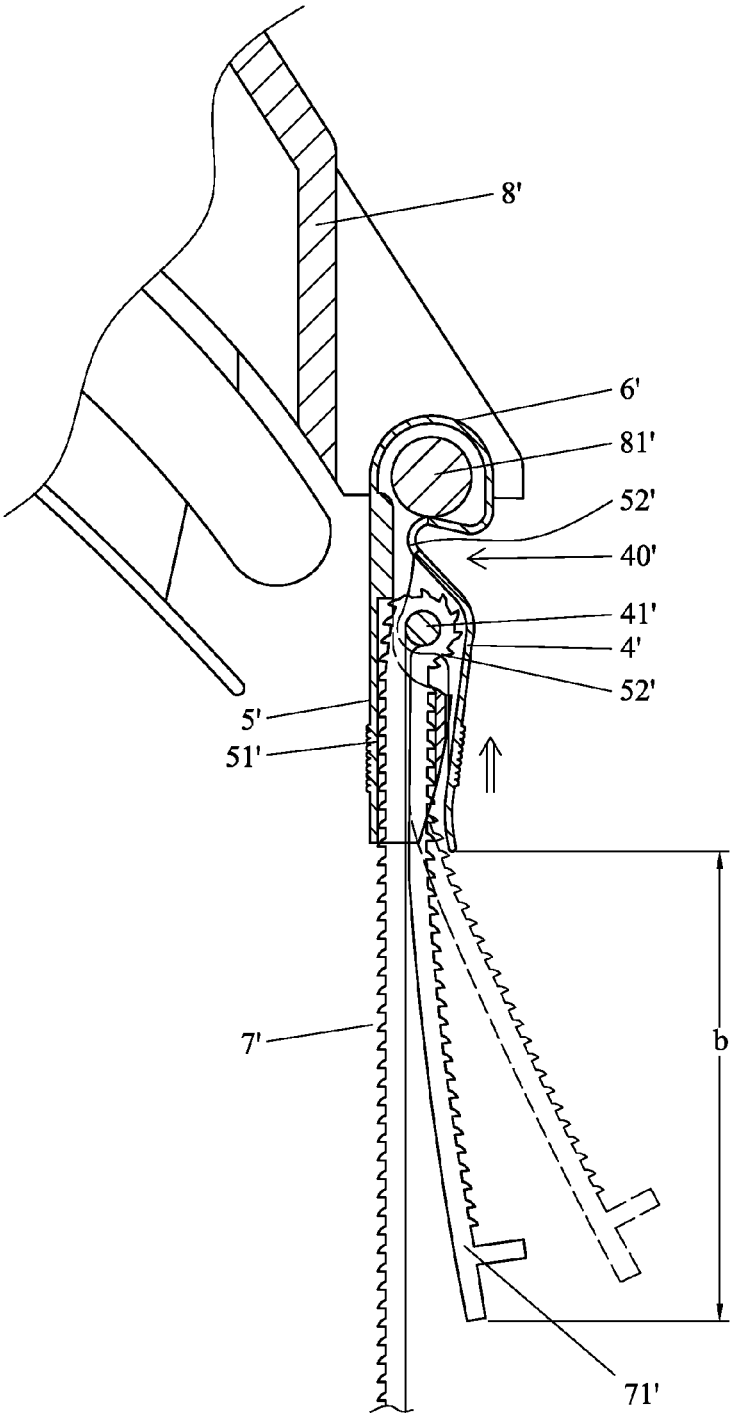
PRIOR ART F I G . 11
FIG. 11 is a partial, cross sectional view illustrating another conventional head strap and buckle device for swimming/diving goggles.
Figure 12:
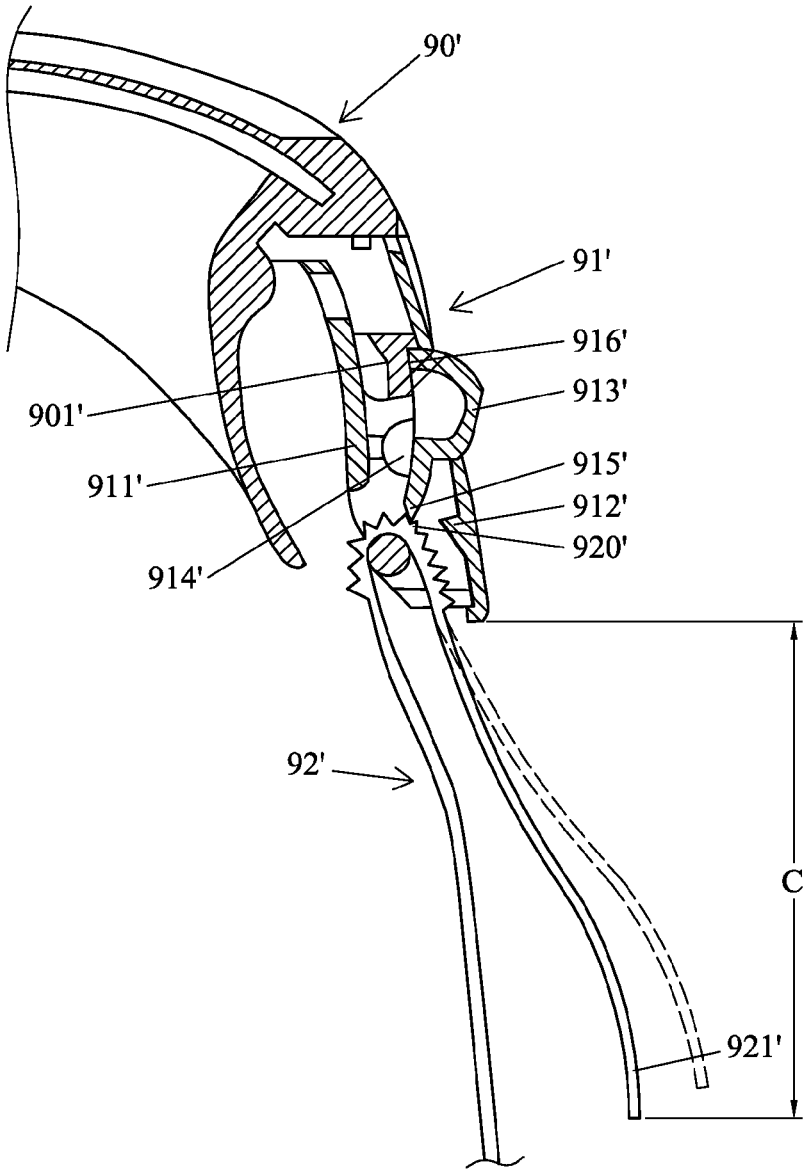
PRIOR ART F I G . 12
FIG. 12 is a partial, top view illustrating a further conventional head strap and buckle device for swimming/diving goggles.

FIGS. 9 and 9A show a swimming/diving goggles of a third example according to the present invention. In this example, the swimming/diving goggles includes first and second buckles 2. The attachment portion 12 is formed on each of the first and second ends 11 of the head strap 1. Furthermore, the head strap turnaround component is a connecting member 5 including first and second pegs 51. The head strap 1 is coupled with the head strap coupling portions 31. The first and second ends 11 of the head strap 1 are located behind the main body 3. The first end 11 of the head strap 1 extends through the rear opening 27 into the space 22 of the first buckle 2, extends through the passage 28 of the first buckle 2, and is wound around the first peg 51. The attachment portion 12 on the first end 11 of the head strap 1 engages with the eccentric axle 24 of the first buckle 2. The second end 11 of the head strap 1 extends through the rear opening 27 into the space 22 of the second buckle 2, extends through the passage 28 of the second buckle 2, and is wound around the second peg 51. The attachment portion 12 on the second end 11 of the head strap 1 engages with the eccentric axle 24 of the second buckle 2.

The holding portion 13 on each of the first and second ends 11 of the head strap 1 extends rearwards through the rear opening 27 of one of the first and second buckles 2. After assembly, on each side of the main body 3, the head strap 1 includes an outer section 14 and an inner section 15 on two sides of one of the first and second pegs 51, with the outer section 14 including the attachment portion 12 and with the outer section 14 of the head strap 1 and the associated buckle 2 being jointly movable.

For each of the first and second buckles 2, a tightening force acting on the inner section 15 of the head strap 1 moves the passage 28 to be in a direction perpendicular to the inner section 15 of the head strap 1 and forms a bend in the passage 28. Furthermore, the inner section 15 of the head strap 1 presses against the lower engagement edge 251 of the front post 25 and the upper engagement edge 261 of the rear post 26, retaining the head strap 1 in place. Operation of the third example is substantially the same as the first example for tightening and loosening the head strap 1 by moving the first and second buckles 2.

The head strap and buckle device according to the present invention can be used on diving goggles. Furthermore, the head strap 1 can be directly tied to the eccentric axle 24 or coupled to the eccentric axle 24 by any suitable provision. In a case that the head strap 1 does not include the holding portion 13, the user can directly pull the head strap 1 by the eccentric axle 24 for adjusting purposes while providing an integral aesthetic appearance.

Although specific embodiments have been illustrated and described, numerous modifications and variations are still possible without departing from the scope of the invention. The scope of the invention is limited by the accompanying claims.

The invention claimed is:

1. Goggles for swimming or diving, comprising: a main body including two sides, with each of the two sides of the main body including a head strap coupling portion; a head strap turnaround component; a head strap including first and second ends, with an attachment portion formed on at least one of the first and second ends of the head strap, and located adjacent to an end edge of one of the respective first and second ends; the head strap coupled with the main body and wound around the head strap turnaround component; at least one buckle, separately disposed away from the main body and connected to the main body by the head strap, the buckle including first and second sidewalls, each of the first and second sidewalls including an upper edge, a lower edge spaced from the upper edge in a height direction, a front edge, and a rear edge spaced from the front edge in a length direction perpendicular to the height direction, a space defined between the first and second sidewalls, an eccentric axle extending between upper front portions of the first and second sidewalls, a front post and a rear post extending between the first and second sidewalls and parallel to each other, the front post separately located between the eccentric axle and the rear post in the length direction, the rear post located between the front post and the rear edge in the length direction, the eccentric axle located between the upper edges and the front post in the height direction, the rear post spaced from the upper edges of the first and second sidewalls in the height direction, a rear opening formed between the rear post and the upper edges of the first and second sidewalls, and a passage defined between the front and rear posts and extending in the height direction, wherein the first end of the head strap extends through the rear opening into the space of the at least one buckle, extends through the passage of the at least one buckle, and is wound around the head strap turnaround component to form a bend, the attachment portion of the head strap engages with the eccentric axle, the head strap includes an outer section and an inner section on two sides of the bend, the outer section includes the attachment portion, and the head strap and the at least one buckle are jointly movable as a whole in a same direction with a same distance, wherein a tightening force acting on the inner section of the head strap makes the inner section form a bend in the passage, and the inner section of the head strap presses against the front post and the rear post, retaining the head strap in place.

2. The goggles for swimming or diving as claimed in claim 1, wherein the attachment portion of the head strap includes an axle hole, and the eccentric axle is received in the axle hole.

3. The goggles for swimming or diving as claimed in claim 1, wherein the attachment portion of the head strap is located adjacent to an end edge of the first end of the head strap, and a holding portion is formed between the first end and the attachment portion of the head strap.

4. The goggles for swimming or diving as claimed in claim 1, wherein the attachment portion is located on the first end of the head strap.

5. The goggles for swimming or diving as claimed in claim 1, wherein the front post includes a lower engagement edge on a lower rear portion thereof, and the rear post includes an upper engagement edge on an upper front portion thereof.

6. The goggles for swimming or diving as claimed in claim 5, wherein the upper front portion of each of the first and second sidewalls of the at least one buckle includes an eccentric hole, and the eccentric axle is received in the eccentric holes.

7. The goggles for swimming or diving as claimed in claim 6, with each head strap coupling portion of the main body including a pin forming the head strap turnaround component, with the at least one buckle including two buckles, with the attachment portion formed on each of the first and second ends of the head strap, wherein each of the first and second ends of the head strap extends through the rear opening of one of the two buckles into the space of one of the two buckles, extends through the passage of one of the two buckles, and is wound around one of the pins of the main body to form the bend, and wherein each attachment portion of the head strap engages with the eccentric axle of one of the two buckles.

8. The goggles for swimming or diving as claimed in claim 6, with the at least one buckle including a buckle, with the attachment portion formed on the first end of the head strap, with the head strap turnaround component being a connecting member including a first side and a second side having a peg, with the head strap coupled with the head strap coupling portions, with the first and second ends of the head strap located behind the main body, with the second end of the head strap fixed to the first side of the connecting member, wherein the first end of the head strap extends through the rear opening into the space of the buckle, extends through the passage of the buckle, and is wound around the peg, and wherein the attachment portion of the head strap engages with the eccentric axle of the buckle.

9. The goggles for swimming or diving as claimed in claim 6, with the at least one buckle including first and second buckles, with the attachment portion formed on each of the first and second ends of the head strap, with the head strap turnaround component being a connecting member including first and second pegs, with the head strap coupled with the head strap coupling portions, with the first and second ends of the head strap located behind the main body, wherein the first end of the head strap extends through the rear opening into the space of the first buckle, extends through the passage of the first buckle, and is wound around the first peg, wherein the attachment portion on the first end of the head strap engages with the eccentric axle of the first buckle, wherein the second end of the head strap extends through the rear opening into the space of the second buckle, extends through the passage of the second buckle, and is wound around the second pea, and wherein the attachment portion on the second end of the head strap engages with the eccentric axle of the second buckle.

* * * * *